US006062544A

United States Patent [19]

Zacharias et al.

[11] Patent Number: 6,062,544

[45] Date of Patent: May 16, 2000

[54] CABLE DRIVE OF A HOISTING MECHANISM

[75] Inventors: Karl Zacharias, Schwerte; Klaus-Jürgen Winter, Wetter, both of Germany

[73] Assignee: Mannesmann AG, Düsseldorf, Germany

[21] Appl. No.: 09/203,077

[22] Filed: Dec. 1, 1998

[30] Foreign Application Priority Data

Dec. 1, 1997 [DE] Germany ..... 197 55 456

[51] Int. Cl.[7] ..... B66D 3/04

[52] U.S. Cl. ..... 254/409; 254/415; 384/252; 474/144; 474/199

[58] Field of Search ..... 254/409, 405, 254/406, 415; 384/252; 474/144, 148, 150, 198, 199

[56] References Cited

U.S. PATENT DOCUMENTS

| | | | |
|---|---|---|---|
| 2,644,666 | 7/1953 | Johnson | 254/415 X |
| 3,262,679 | 7/1966 | Eggleton, Jr. et al. | 254/409 |
| 5,831,222 | 11/1998 | Fanger et al. | 177/147 |

FOREIGN PATENT DOCUMENTS

| | | | |
|---|---|---|---|
| 1168175 | 4/1964 | Germany | 254/415 |
| 196 10 662 | 3/1998 | Germany . | |
| 61986 | 11/1912 | Switzerland | 254/415 |

*Primary Examiner*—Donald P. Walsh
*Assistant Examiner*—Minh-Chau Pham
*Attorney, Agent, or Firm*—Cohen, Pontani, Lieberman & Pavane

[57] ABSTRACT

A cable drive for a hoisting mechanism, including a carrying element having a recess, at least one of a top block and a cable end attachment, each of which has a horizontal swivel axle having two ends, and bearing elements swivelably mounted at both ends of the axle so that each of the bearing elements is rotatable by 180 degrees relative to its vertical central plane. The bearing elements are arranged in the recess of the carrying element, each bearing element having a laterally offset bearing bore in which the swivel axle is mounted so that movement of the bearing element causes a lateral parallel movement of the swivel axle.

8 Claims, 7 Drawing Sheets

CABLE DRIVE OF A HOISTING MECHANISM

BACKGROUND OF THE INVENTION

1. Field of the Invention

The invention relates to a cable drive of a hoisting mechanism.

2. Discussion of the Prior Art

German reference DE 196 10 662 A1 discloses a top block, which has a carrying frame open toward the bottom. Arranged in the carrying frame is a carrying device, in which a cable sheave is mounted in freely rotatable fashion. The carrying device is swivel-mounted around a horizontal swivel axis, so that the carrying device automatically positions itself in the cable pull direction. The swivel axis is mounted by means of bearing bushes. For support on the carrying frame, the bearing bushes are placed into recesses provided for this purpose.

It is disadvantageous in this top block that the same carrying frame cannot be used both for top blocks and for cable end attachments, e.g., cable wedge crossbars, or both for a 4/1 cable reeving and for a 2/1 cable reeving, because when the same carrying frame is used, the application line of the load no longer corresponds to the runway carrier middle.

SUMMARY OF THE INVENTION

Accordingly it is an object of the present invention to provide a cable drive of a hoisting mechanism, with a top block and/or a cable end attachment, that is embodied so that only a few manual manipulations allow the cable drive to be used both for a 4/1 cable reeving and for a 2/1 cable reeving, whereby in both cases the application line of the load corresponds to the runway carrier middle.

Pursuant to this object and others which will become apparent hereafter, one aspect of the present invention resides in a cable drive of a hoisting mechanism with a top block and/or a cable end attachment, each of which has a horizontal swivel axis that is swivel-mounted at both ends via a bearing element arranged in a recess of a carrying element of the hoisting mechanism. The bearing element, which can be moved by 180 degrees relative to its vertical central plane by means of rotation, has a laterally offset bearing bore, so that when the bearing element is moved, the swivel axis undergoes a lateral parallel displacement. The invention thus makes it possible to move the swivel axis laterally and in parallel fashion simply by moving the bearing element by a predetermined distance. It is therefore possible, with relatively little expense, for one and the same cable drive of a hoisting mechanism to be operated both with a 4/1 cable reeving and with a 2/1 cable reeving, whereby, in each case, the application line corresponds to the runway carrier middle.

Especially simple operation is achieved when the recesses are open on the top and the bearing bush can be inserted from above.

Advantageously, the bearing element is embodied as a bearing bush insertable into the housing, so that the bearing bush can be exchanged when wear occurs.

To attain good force transmission to the housing of the cable drive, in another embodiment of the invention, the shape of the recesses in their lower area complements the lower side of the bearing bush so that, upon insertion of the bearing bush, a positive-locking connection is obtained.

The bearing bush can be simply fixed in place when the bearing bush has two lateral elastic holding elements slanting upward and outward that, when the bearing bush is inserted, fix the bearing bush in place on inwardly directed projections of the recesses, locking behind these projections.

In another embodiment of the invention the holding elements are embodied in a bar-like manner.

In still a further embodiment the bearing bushes are made of thermoplastic plastic, which permits simple manufacture.

When the bearing bushes are produced by the injection molding process, no post-processing is necessary.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matte in which there are illustrated and described preferred embodiments of the invention.

DETAILED DESCRIPTION OF THE PREFERRED EMBODIMENTS

Figure 1:
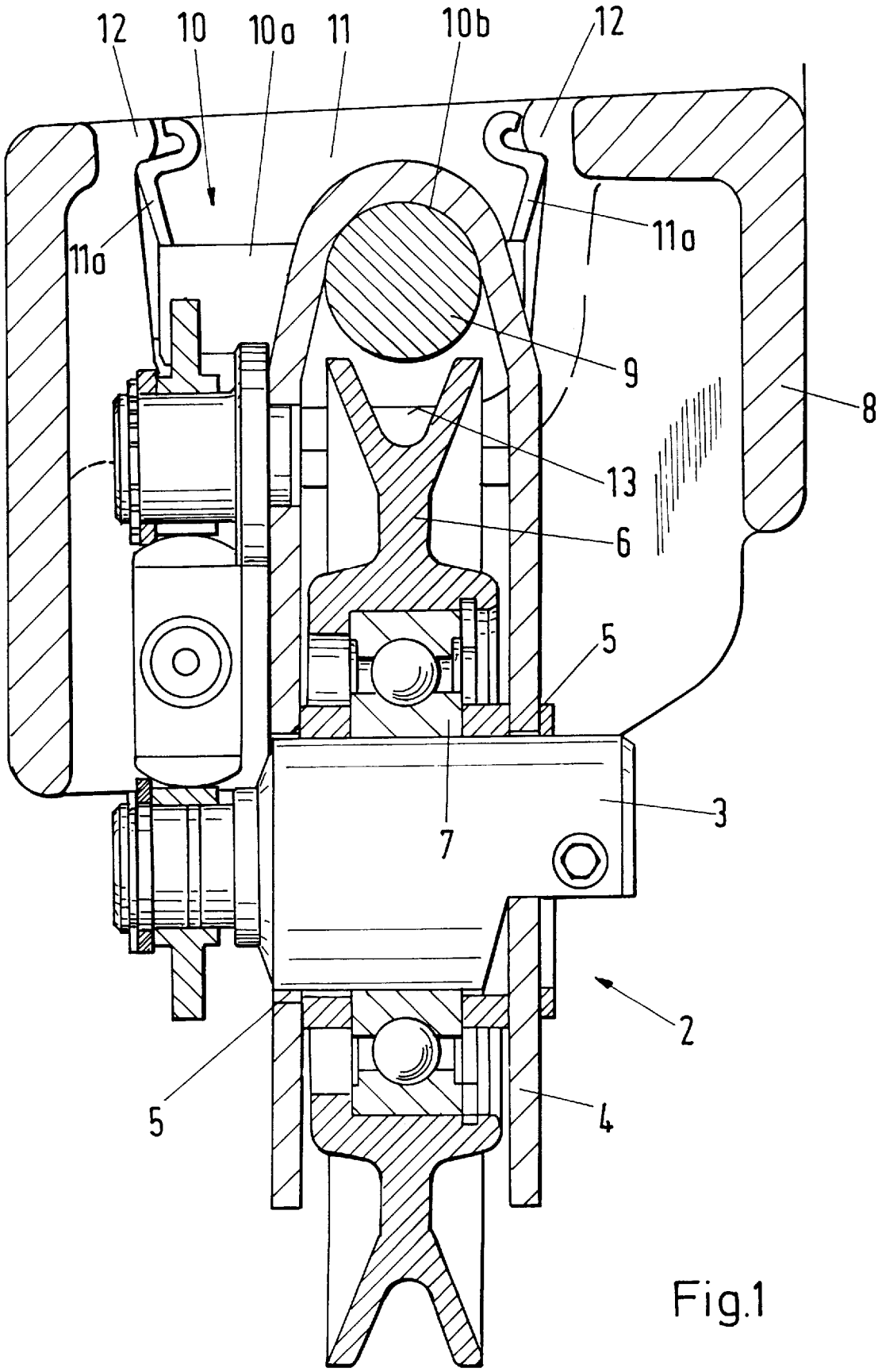
FIG. 1 is a cross-section through a top block along sectional line N–O as in FIG. 3.

The top block of a hoisting mechanism shown in cross-section in FIG. 1 comprises a carrying device 2, in which there is a horizontally arranged axis 3, whose ends are supported in openings 5 of lateral carriers 4 of the carrying device 2. A cable sheave 6 is mounted on the axis 3 in freely rotatable fashion via a rotary bearing 7. As FIG. 1 shows, the carrying device 2 is mounted swivelably in a carrying frame 8 at a right angle to the axle 3. For this purpose, the carrying frame 8 is equipped with a cylindrical swivel axle 9.

The horizontal swivel axle 9 is rotary-mounted at both ends via a bearing bush 10*a* embodied as a bearing element 10, so that the swivel axle 9 is swivelable inside the bearing bore 10*b*. The bearing bush 10*a* is placed in a recess 11 of a carrying element embodied as the carrying device 2. The recess 11 is open toward the top, so that the bearing bush 10*a* is insertable from above into the carrying frame 8. As FIG. 1 shows, inwardly directed projections 12 are embodied in the carrying frame 8, so that two bar-like elastic holding elements 11*a* arranged laterally on the bearing bush 10*a* and slanting upward and outward serve, upon insertion of the bearing bush 10*a*, to fix the bearing bush 10*a* in place, locking behind the projections 12. To ensure the elasticity of the holding elements 11*a*, the bearing bush 10*a* can be produced from thermoplastic plastic, as a result of which very good sliding properties of the swivel axle 9 in the bearing bore 10*b* are attained. The shape of the recess 11 in its lower area 13 complements the bearing bush bottom 14 in such a way that, when the latter is placed into the recess 11, a positive-locking connection is created.

Figure 1A:
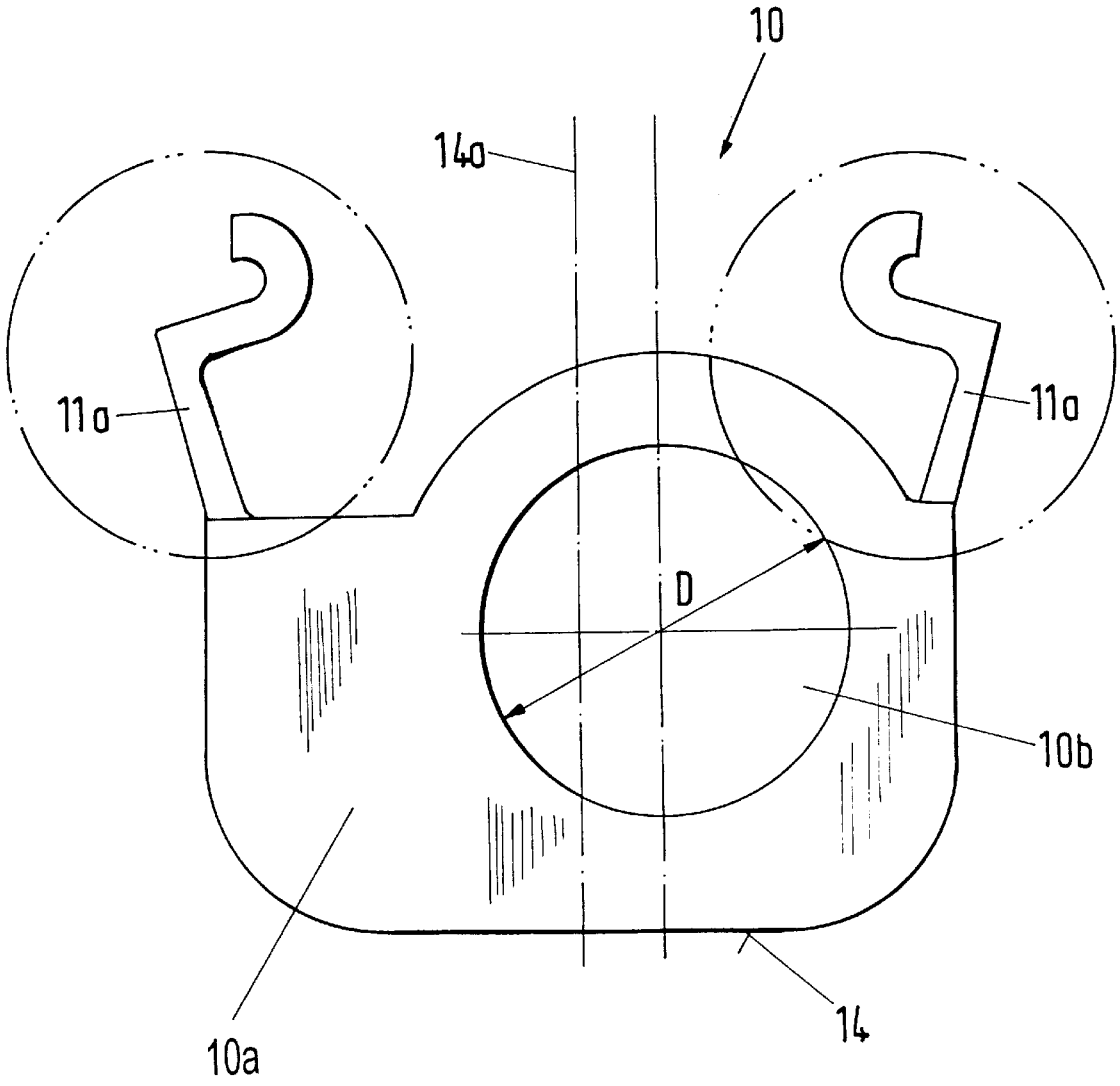
FIG. 1*a* shows the bearing bush of FIG. 1.

A front view of the bearing bush is shown in FIG. 1*a*. This drawing clearly shows that the bearing bore 10*b* is arranged laterally offset to the vertical central plane and has a diameter D. The outer contour of the bearing bush 10*a* is mirror-symmetrical relative to the vertical central plane 14*a*. When the bearing bush 10*a* is turned by 180 degrees, a lateral parallel movement of the bearing boring 10*b* occurs in the horizontal direction. The complementary shape of the recess 11 makes it possible to move the bearing bush 10*a* by 180 degrees by means of rotation, and thus to move the swivel axle 9 by a predetermined distance in the horizontal direction.

Figure 2:
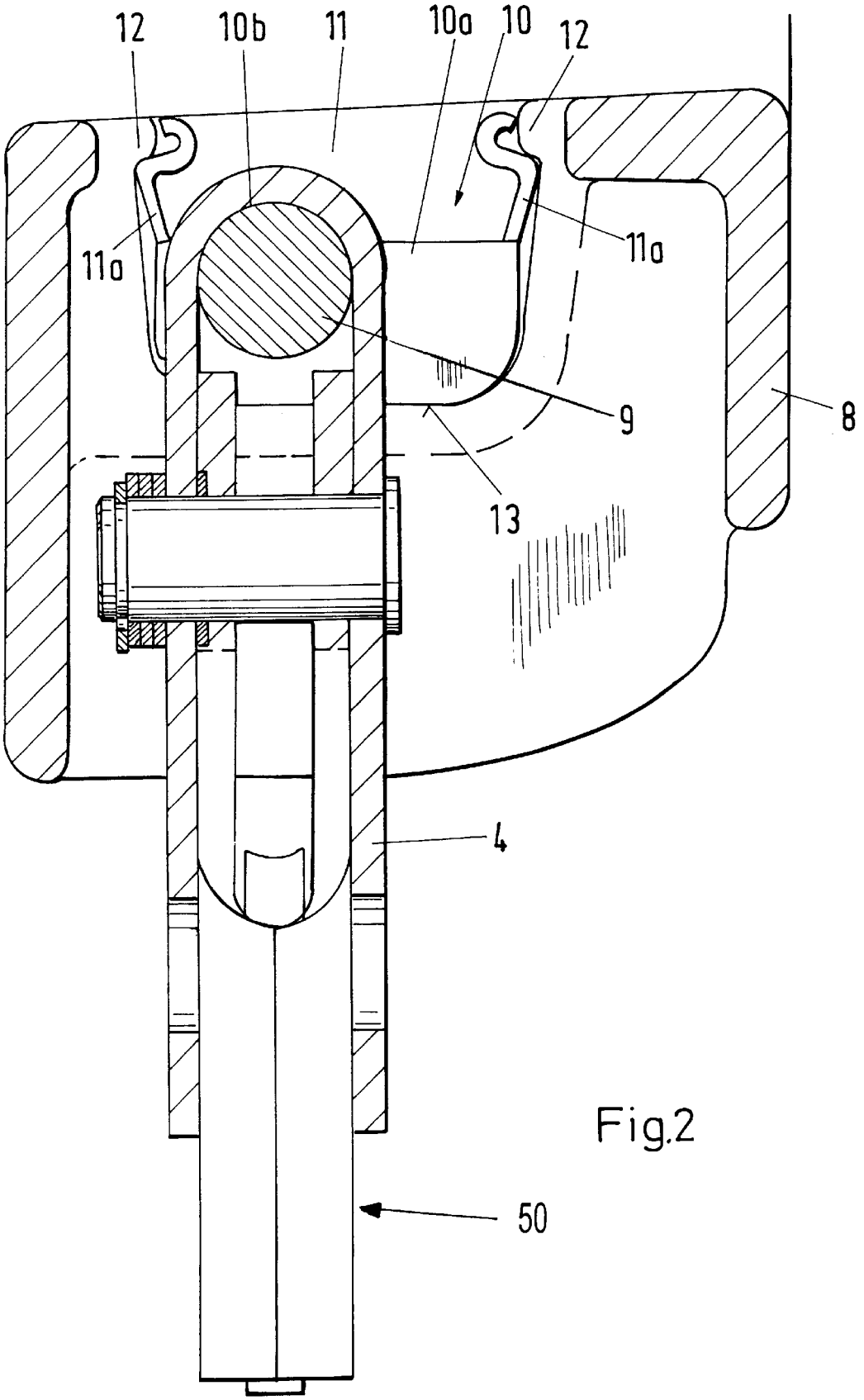
FIG. 2 is a cross-section through a cable wedge crossbar as in FIG. 1, with an offset swivel axis.

FIG. 2 shows a cable end attachment embodied as a cable wedge crossbar 50. Otherwise, this embodiment agrees with that in FIG. 1, although with a bearing bush 10*a* rotated by 180 degrees and thus a laterally offset swivel axle 9.

Figure 3:
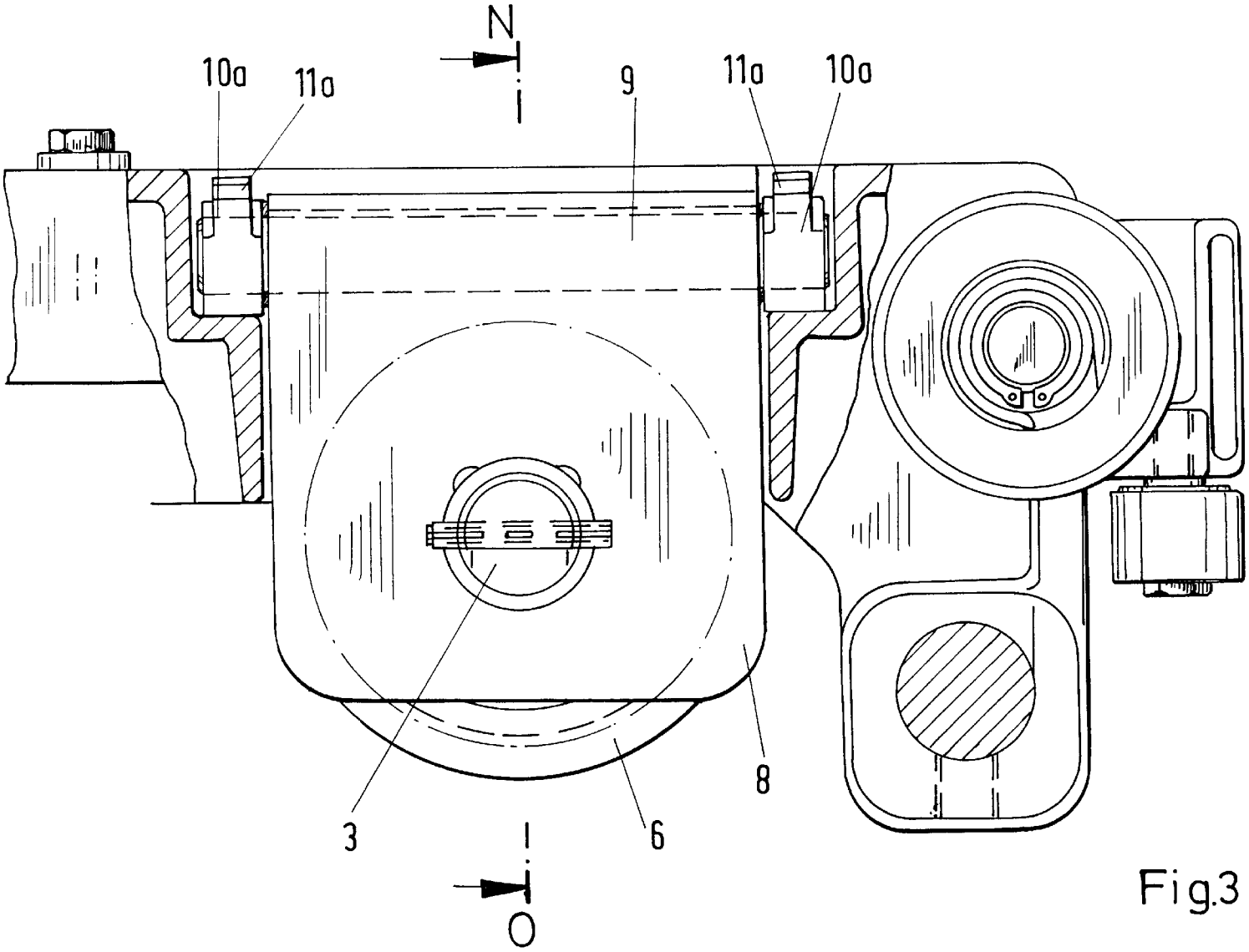
FIG. 3 is a front view of the top block of FIG. 1.

FIG. 3 shows a front view of the cable drive, in which the cross-section along the sectional line I—I corresponds to FIG. 1.

Figure 4:
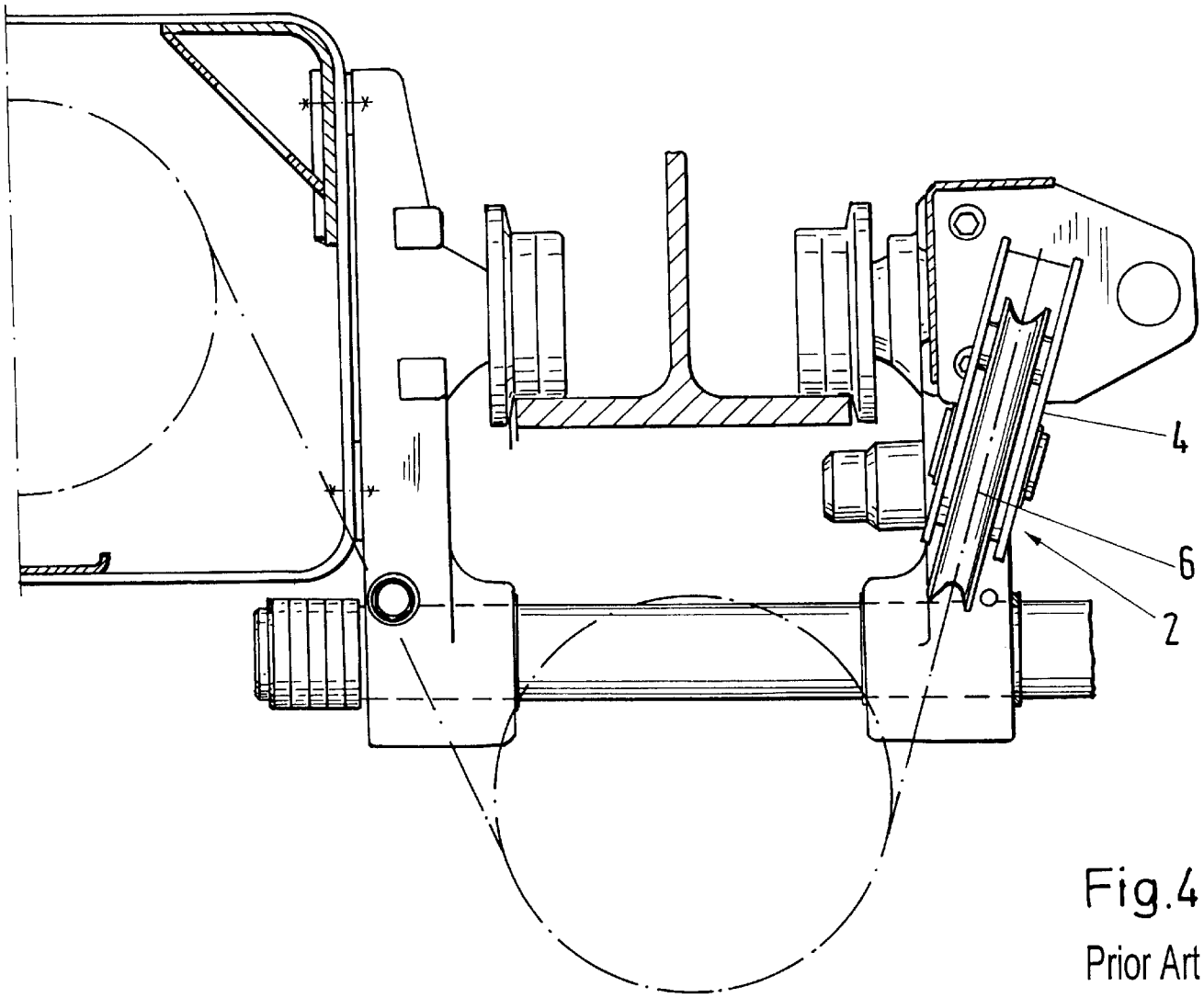
Fig.4 Prior Art
FIG. 4 is an overview of a cable drive with a top block and cable sheave.
Figure 5:
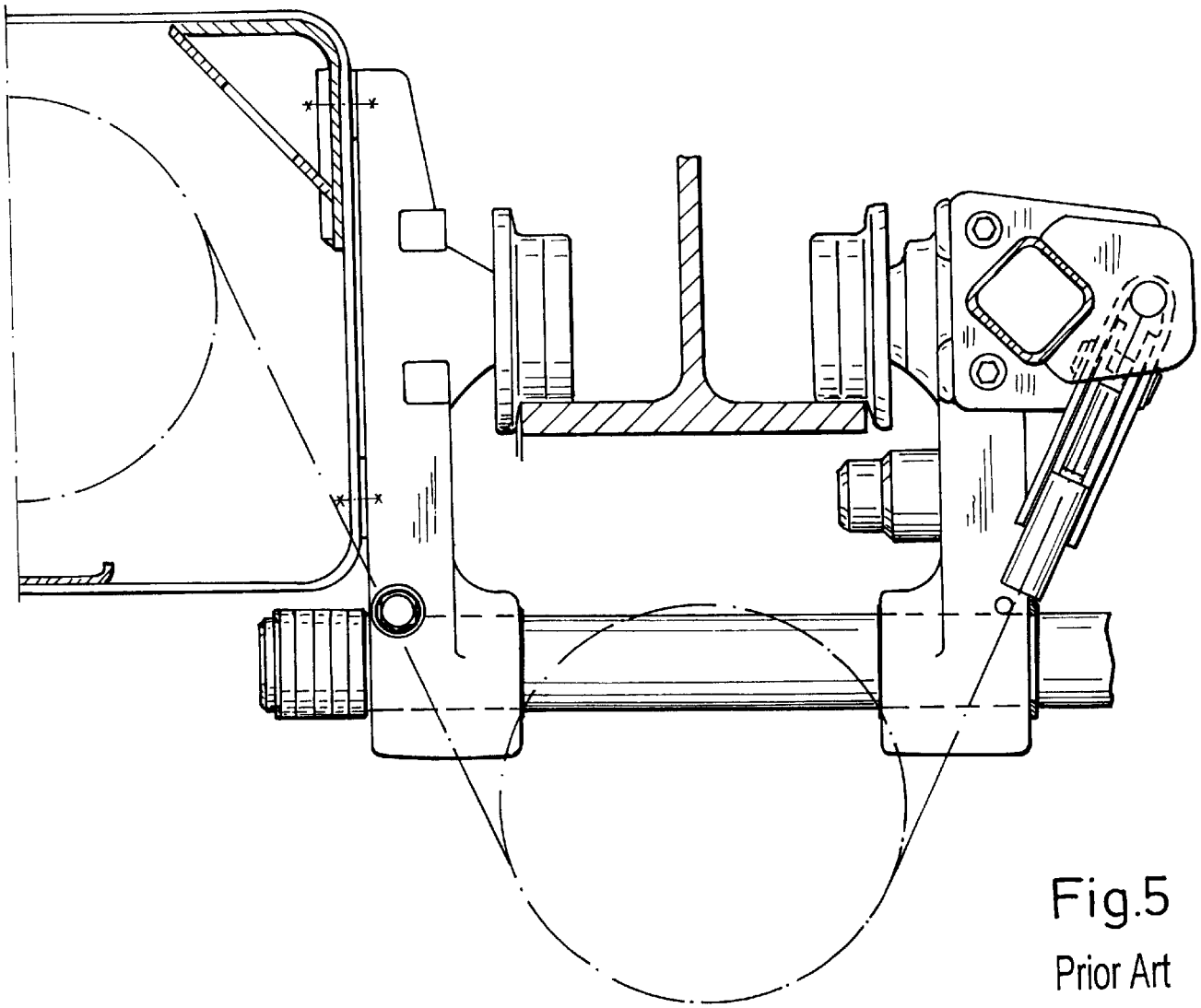
Fig.5 Prior Art
FIG. 5 is a view like similar to FIG. 4, with a cable wedge crossbar.
Figure 6:
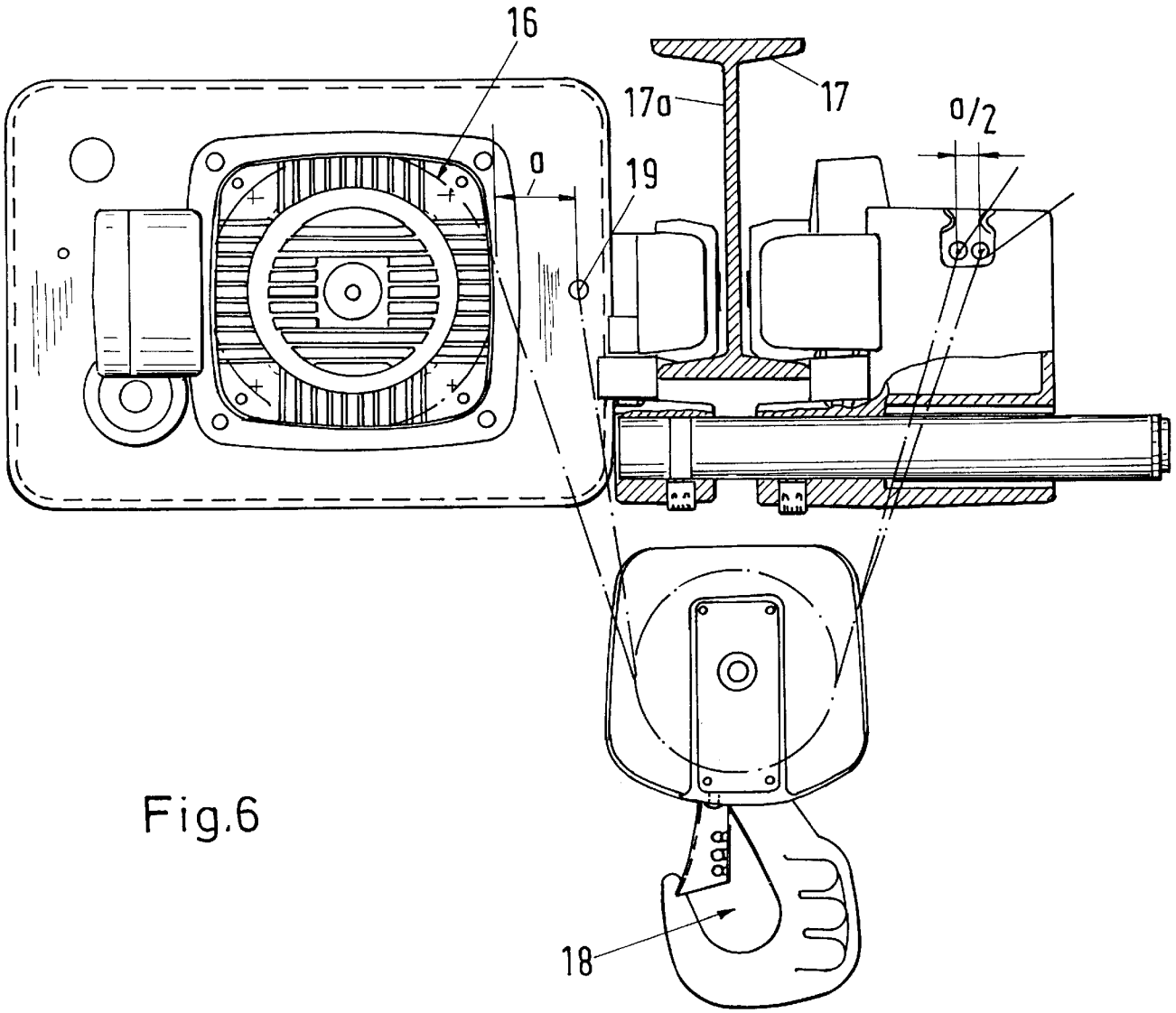
FIG. 6 is a schematic depiction of a cable drive with offset swivel axes.

To permit better understanding of the invention, FIGS. 4 and 5 show schematic depictions, representing the known prior art, of a cable drive with top block (FIG. 4) and cable wedge crossbar (FIG. 5). Moreover, FIG. 6 shows a schematic depiction of a cable drive with a cable drum 16, a running rail 17 and a runway carrier middle 17*a*; the application line 18 of the load is also indicated. As FIG. 6 shows, the cable anchor point 19 can only be arranged offset by a distance a relative to the cable drum surface. However, upon a changeover from a 4/1 cable reeving to a 2/1 cable reeving (and vice versa), this leads to a discrepancy between the application line 18 and the runway carrier middle 17*a* if, as FIG. 6 shows, the swivel axle 9 is not also moved in parallel fashion by a/2. The parallel movement of the swivel axle 9 can be accomplished by moving the bearing bush 10*a* by a few manual manipulations. Thus, the cable drive of the present invention can be simply converted from a 2/1 cable reeving to a 4/1 cable reeving (and vice versa).

The invention is not limited by the embodiments described above which are presented as examples only but can be modified in various ways within the scope of protection defined by the appended patent claims.

We claim:

1. A cable drive for a hoisting mechanism, comprising:

a carrying element having a recess;

at least one of a top block and a cable end attachment, each of which has a horizontal swivel axle having two ends; and bearing elements swivelably mounted at both ends of the axle so that each of the bearing elements is rotatable by 180 degrees relative to its vertical central plane, the bearing elements being arranged in the recess of the carrying element, each bearing element having a laterally offset bearing bore in which the swivel axle is mounted so that movement of the bearing element causes a lateral parallel movement of the swivel axle.

2. A cable drive as defined in claim 1, wherein each of the bearing elements is a bearing bush.

3. A cable drive as defined in claim 2, wherein the recess opens upwardly, each bearing bush being configured to be insertable in the recess from above.

4. A cable drive as defined in claim 2, wherein the recess has a lower area shaped to complement a lower side of the bearing bush so that, upon insertion of the bearing bush, a positive-locking connection is established.

5. A cable drive as defined in claim 2, wherein inwardly directed projections are provided at the recess, each of the bearing bushes having two lateral elastic holding elements that extend upwardly at an angle and engage behind the inwardly directed projections of the recess so as to fix the bearing bush in place.

6. A cable drive as defined in claim 5, wherein the holding elements are configured to be bar-like.

7. A cable drive as defined in claim 2, wherein the bearing bush is made from thermoplastic.

8. A cable drive as defined in claim 2, wherein the bearing bush is configured so as to be producible by injection molding.

* * * * *